United States Patent [19]

Dullinger

[11] 3,987,901

[45] Oct. 26, 1976

[54] STACKED LABEL PACKAGE AND METHOD OF MAKING IT

[75] Inventor: Karl Dullinger, Neutraubling, Germany

[73] Assignee: Hermann Kronseder, Worth (Danube), Germany

[22] Filed: Nov. 7, 1974

[21] Appl. No.: 521,988

[30] Foreign Application Priority Data

Nov. 24, 1973 Germany ..... 2358579
July 10, 1974 Germany ..... 23388

[52] U.S. Cl. ..... 206/451; 206/460; 206/813

[51] Int. Cl.[2] ..... B65D 71/02; B65D 85/62

[58] Field of Search ..... 206/214–215, 206/425, 442, 449, 451, 460, 477–479, 497, 805, 813, 83.5, 73; 229/DIG. 12; 312/50

[56] References Cited

UNITED STATES PATENTS

| | | | |
|---|---|---|---|
| 2,018,611 | 10/1935 | Feurstein | 206/451 X |
| 2,485,789 | 10/1949 | Thomas | 206/460 X |
| 2,956,674 | 10/1960 | Weilby | 206/813 |
| 3,126,680 | 3/1964 | Baird, Jr. et al. | 229/DIG. 12 |
| 3,331,105 | 7/1967 | Gordon | 229/DIG. 12 |
| 3,351,185 | 11/1967 | Blumer | 206/451 |
| 3,459,297 | 8/1969 | Templeton | 206/460 X |
| 3,698,547 | 10/1972 | Roberts et al. | 206/813 |
| 3,780,854 | 12/1973 | Ruppenthal | 206/478 |
| 3,851,762 | 12/1974 | Liblick | 206/460 X |

*Primary Examiner*—William T. Dixson, Jr.
*Attorney, Agent, or Firm*—Joseph P. House, Jr.

[57] ABSTRACT

In order to save time and labor when reloading the label magazine of a labeling machine, a relatively large number of labels, such as 3000 to 8000, are piled into a stack, and binding means running along relatively opposite longitudinal sides of the stack and across its opposite end faces are applied to the stack so as to stabilize it. The binding means consists of adhesive tape or of a band of stretchable synthetic material, with or without a low backing trough of cardboard along one side of the stack. The binding means is removed after the unitary label package has been inserted into the magazine of the labeling machine.

6 Claims, 6 Drawing Figures

STACKED LABEL PACKAGE AND METHOD OF MAKING IT

The subject of the present invention is a method of packaging stacked labels as well as a unitary package which is obtainable by the method.

BACKGROUND OF THE INVENTION

A customary method of packaging labels is to gather the labels during or after their manufacture into individual packets of about a thousand single labels, to bundle such packets by means of paper strips, and to wrap the packets one by one or in groups with packing paper or the like. This heretofore known method due to the relatively small packets is very tedious and expensive. By means of the paper strips no solid assemblage of the packet is obtainable, and consequently the labels may easily get out of place during transport. The reloading of the label magazine or label container of labeling machines with the label packets is extremely time consuming because only a small quantity of labels can be unpacked at a time and, after removal of the bundling strip, be inserted. Again, during the reloading the labels may get out of place and thereby upset the functioning of the labeling apparatus.

Another method has heretofore been known wherein a larger number of labels is held together by a bundling strip. In this manner, however, a label stack which is in itself a stable unit cannot be obtained, especially if the bundling strips are perforated to provide a tearline. The stack, therefore, must be manipulated together with a trough shaped thick walled transport container and inserted into a matching, especially designed magazine of a labeling machine, by means of which the label stack is transferred from the transport container which conforms with the shape of the labels, into the label container of a labeling machine. This heretofore known method causes high packaging costs and entails a large amount of machinery to provide the required magazine on the labeling machine. The labels are only insufficiently protected by the transport container, and a changeover to different label shapes is extremely wearisome and expensive.

SUMMARY OF THE INVENTION

The object of the present invention, therefore, is to provide an adaptable, cost-saving method of packaging labels as well as a unitary label package whereby the label container of a labeling machine may be readily and quickly refilled and malfunctionings due to out-of-place labels are positively prevented.

With respect to the method this object is achieved by gathering several thousand single identical labels into a continuous stack and then, by means of a tapelike binding element which extends lengthwise of the stack, tying the labels into a stable transport and refill unit which is directly insertable into the magazine of a labeling machine. This method has several important advantages. By making up a stable manipulation unit from several thousand labels into the form of a label bar, the labor to package and replenish the labels is materially reduced. The packaging operation may, therefore, be automated, especially if the transport and refill unit is, as further contemplated by the invention, wrapped with a shrinkable synthetic film and the latter is shrunk in place after sealing of seams, if any, by welding. However, the transport units may also be wrapped individually or in groups with packing paper or the like. During reloading the complete transport and refill unit is inserted into the label container of a labeling machine after the wrapping, if used, has been partly or completely removed; and the tapelike binding element is then severed and removed. The labels may therefore not get out of place either during the packing or during transport and reloading. It is also important to note that the insertion of the refill unit into a label container or the like is not impeded by the tapelike binding element, and that the packaging costs may be kept low.

The invention further contemplates to bind the individual labels together by means of at least one adhesive tape. Surprisingly, it has been discovered that in this manner a stack of about 7000 individual labels can easily be tied into a stable transport and refill unit, particularly if the adhesive tape is arranged so that it extends along two opposite longitudinal sides of the stack from one end face thereof to the other. In that case it is best if the cohesion of the stick coating and its adhesion to its backing strip are greater than the adhesion of the stick coating to the labels.

The invention further contemplates to tie the individual labels together by means of at least one weldable synthetic tape which may also be shrinkable. This is also a suitable manner to make up an extremely stable transport and refill unit with little effort, because a single tape which exends along two opposite longitudinal sides and across the two end faces, and which exerts a certain pressure upon the labels, is entirely sufficient.

A further possibility, according to the invention, is to tie the individual labels together by at least one rubber band. This manner of holding the labels together is particularly advantageous if, as further contemplated by the invention, several thousand identical labels are gathered into a continuous stack and are tied together by means of a binding element which at least extends lengthwise of the stack and with at least one elongated backing element so as to provide a stable transport and refill unit that may be inserted directly into the magazine of a labeling machine. In this case, part of the stabilizing effect is produced by the backing element which preferably consists of a channeled cardboard section. This procedure is particularly adapted for the packing of relatively small labels.

With respect to the unitary package, the object of the invention is achieved by the provision of a continuous stack of several thousand identical individual labels and at least one tapelike binding element which ties the individual labels into a stable transport and refill unit which may be inserted directly into the magazine of a labeling machine. Such a unitary package substantially facilitates the packaging and refilling of the labels.

Another solution of the stated problem is possible by providing a continuous stack of several thousand identical individual labels, at least one elongated backing element, and at least one tapelike binding element which extends in the longitudinal direction of the stack and which ties the individual labels and the backing element into a stable transport and refill unit which may be inserted directly into the magazine of a labeling machine.

According to a particularly advantageous practice, the object of the invention is achieved by the provision of covering elements at the end faces of the barlike label stack and by the provision of at least one pair of adhesive tapes which extend respectively along longitudinal sides and across both end faces of the stack, which exert a preloading pressure upon the end faces of the label stack, which stick to the edges of the labels and whose ends are connected together. In this manner it is possible to produce stacks of 6000 and more individual labels, which have an extremely stable configuration and which may be manipulated without auxiliary equipment and inserted directly into the label container of a labeling machine. The stabilization of the stack is obtained in part by the friction between the labels which is caused by the preloading pressure, and in part by the sticking of the adhesive tapes to the labels. Pressure activated or thermally activated adhesive tapes may be used and care should be taken that the cohesion of the stick coating and its adhesion to the backing strip is greater than the adhesion of the stick coating to the labels so that none of the stick coating remains on the labels after the adhesive tape has been peeled off. The preloading pressure may be produced by compressing the stack longitudinally before the adhesive tape is applied, and/or by applying the adhesive tape while it is kept in a preloaded or elastically tensioned condition. The costs of producing such a stack are extremely low because the packing of the stack consists only of a few stretches of adhesive tape and of the two covers for the end faces.

As further contemplated by the invention, it is particularly advantageous to provide the two end covers of the stack by the two end labels. In this manner the costs for special end covers are saved and only the two end labels are wasted.

As another refinement, the invention contemplates to form a tab like handle by the connected ends of the adhesive tapes. In this manner the handling of the stack is facilitated, particularly during the pulling of the tapes from the stack.

While one pair of adhesive tapes is sufficient in case of relatively small labels, stacks of larger labels are tied together, according to the invention, by two pairs of adhesive tapes which cross each other at the end faces of the stack and at which the tablike extensions are offset relative to each other.

According to a further embodiment of the invention, two pairs of adhesive tapes are provided which extend along the same longitudinal sides of the stack. This arrangement too affords a particularly stable label stack and is particularly adapted for what is known as chest labels.

A label stack embodying the invention may be inserted, as has already been stated, directly into the conventional label containers of labeling machines. This is made possible by dimensioning the width of a stack, depending on the arrangement of the adhesive tapes, exactly as large as the width of an individual label or only as large as the combined label width and twice the tape thickness. Since during the refilling several thousand labels are inserted at a time, the efficiency is high. By using several pairs of adhesive tapes or by using tapes of different widths widely varying label shapes and sizes may be taken care of.

DESCRIPTION OF THE DRAWINGS

The foregoing and other objects and advantages of the invention will become more fully apparent as this specification proceeds with reference to the accompanying drawings wherein.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
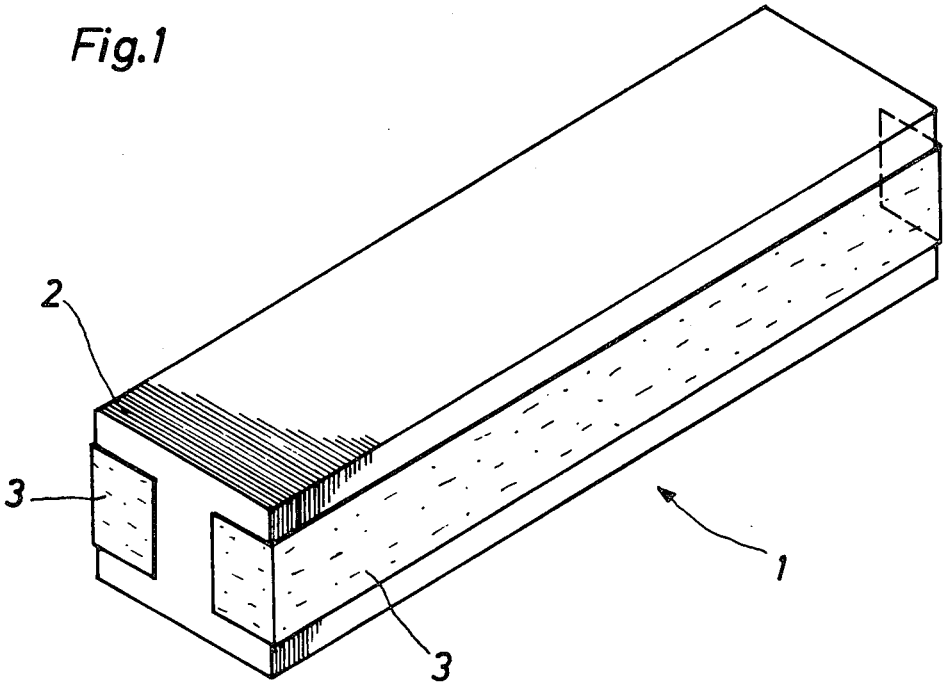
FIGS. 1–6 are perspective views of several label transport units embodying the invention.

The unitary package 1 shown in FIG. 1 comprises a continuous stack of for instance 7000 identical labels 2 of rectangular shape, and two adhesive tapes 3. The two adhesive tapes 3 are fastened to two relatively opposite longitudinal sides of the stack and their ends extend partly over the two end faces of the stack. By means of the adhesive tapes 3 the labels 2 are tied into a stable transport and refill unit. "Stable" in the sense of the invention means that the stack when manually or mechanically picked up and moved does not fall apart and the labels do not lose their mutual orientation. A certain flexibility or twistability of the unit is therefore entirely permissible. A particularly great stability is obtained if the adhesive tapes exert a certain pressure upon the end faces of the stack and the friction between the labels is thus enhanced. The transport and refill unit is completely surrounded by a wrapping of shrink film, not shown, which, for instance, may consist of a length of tubing which is sealed by welding at the two end faces of the stack. In this manner the labels are particularly well protected against environmental influences.

Figure 2:
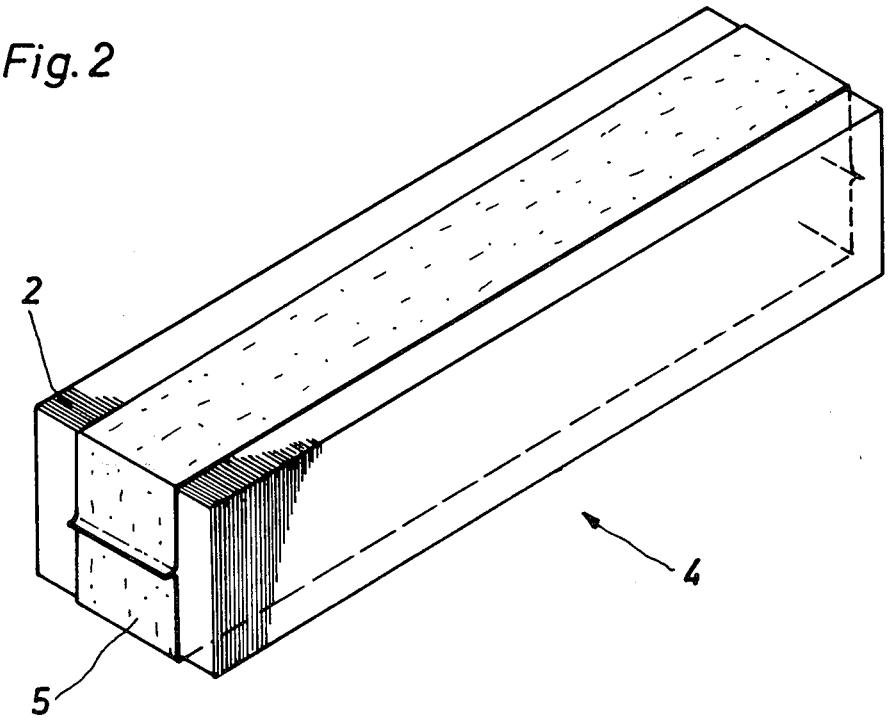

The package unit 4 according to FIG. 2 differs from the one shown by FIG. 1 in that the individual labels are tied into a stable transport and refill unit by means of an endless synthetic band 5 which, as applied, is in a pretensioned condition. This band extends along two relatively opposite longitudinal sides of the stack and across its end faces, and end portions of the band are joined by welding or gluing. The band 5 may also be made up by joining two lengths thereof together.

The method of producing a unitary package according to FIG. 1 is as follows: First, after the labels have been cut or stamped, a continuous stack of about 3000 to 8000 individual labels is made up. The suitable size of the stack depends on the material of the labels and on the type of the connecting means. The gathering of the labels may be accomplished for instance, in the discharge chute of a trunk-type stamping press by partitioning and temporary acceleration of the respective labels. At the same time, two adhesive tapes which have previously been attached to the leading label, are pulled from supply reels at opposite sides of the discharge chute; the tapes are pressed against the longitudinal sides of the advancing stack; they are attached to the last label; and the tapes are then cut off. For best results the adhesive tapes may be applied while in a certain pretensioned condition, or the stack may be compressed lengthwise while the adhesive tapes are being applied, in order to enhance the friction between the labels. The individual labels are thus tied by the adhesive tapes into a stable transport and refill unit.

Thereafter, the finished transport and refill units are passed through a film attaching and welding station where they are wrapped with shrink film and the seams of the shrink film are sealed by welding. Subsequently, the units are conveyed through a tunneltype furnace in which the shrink film is brought into close contact with the stack and with tie elements thereof. The unitary package is then ready for shipment.

The method of producing the package unit 4 according to FIG. 2 differs from the above described method in that instead of an adhesive tape a band of synthetic material is applied to each of two opposite sides of the stack. In practice, the bands are welded together ahead of the stack, then strung around the stack, again connected by welding behind the stack and cut off. In this case it is particularly important that the band exerts a certain pressure upon the end faces of the stack. This may be accomplished simply by using shrinkable synthetic film for the band and tensioning it by heat treatment which, if desired, may be effected together with the shrinking of the wrapping material.

At the consumer of the labels the refill units are inserted into the label container of the labeling machine after the shrink foil has been removed in its entirety or in part, whereupon the adhesive tapes or synthetic bands are also cut and removed together with any remaining portion of the wrapper.

Figure 3:
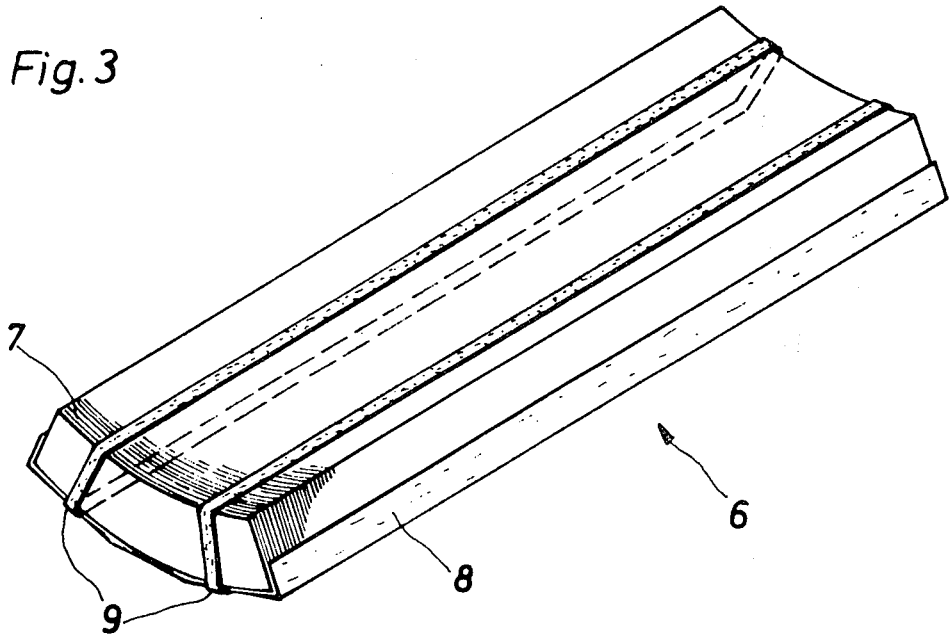

The package unit 6 according to FIG. 3 comprises a continuous stack of, for instance, 7000 identical arcuate labels 7, a trough shaped backing section 8 and two rubber bands 9 which tie the labels 7 and the backing section 8 into a transport and refill unit. The backing section 8 consists of a bent cardboard portion conforming with the shape of the labels, and it embraces the label stack as its bottom face and partly at its side faces, whereby adequate stability is insured. The rubberbands are at one side thereof in contact with one longitudinal side of the stack, and at the other side with the backing section and they extend across the two end faces. At one or at both end faces of the backing section 8 tabs, not shown, may be provided which abut the end face or end faces of the stack. The transport or refill unit is completely surrounded by a wrapping of shrink film, not shown.

Figure 4:
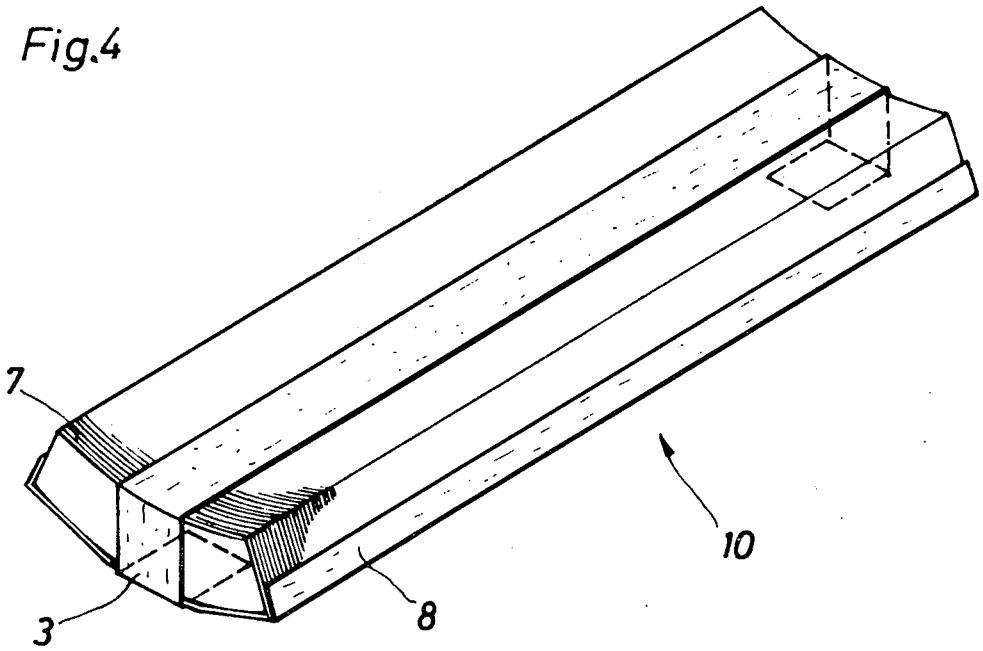

The package unit 10 according to FIG. 4 differs from the one shown in FIG. 3, in that the connection between the backing section 8 and the labels 7 is formed by an adhesive tape 3 which extends in the longitudinal direction of the stack. The adhesive tape covers a longitudinal side and the two end faces of the stack and is attached to the underside of the backing element. In this case it is sufficient if only those portions of the adhesive tape which are in contact with the backing section are provided with a layer of adhesive. An endless band according to FIG. 2 may also be used.

The method of producing the package units 6 and 10 according to FIGS. 3 and 4 is initially the same as that which has been described hereinbefore with reference to FIG. 1. However, after or during the gathering of the individual labels into a continuous stack the labels are transferred into the backing section, for which purpose the backing section may, for instance, be integrated with the discharge chute of a trunk type stamping press. Thereafter, the rubber bands are slipped on or the adhesive tape 3 is applied to the stack and fastened to the backing section. In this manner the labels and the backing section are tied into a stable transport and refill unit. The further method steps for the wrapping of the transport unit may then be carried out as in the method described hereinbefore with reference to FIG. 1.

At the label consumer the complete refill units including the backing sections are inserted into the label container of a labeling machine. Thereafter, the tie elements are cut and may be removed together with the backing section from the container. The wrapper is either completely removed before the insertion into the container, or it is opened at one end face only and removed together with the backing section and the tie elements.

Figure 5:
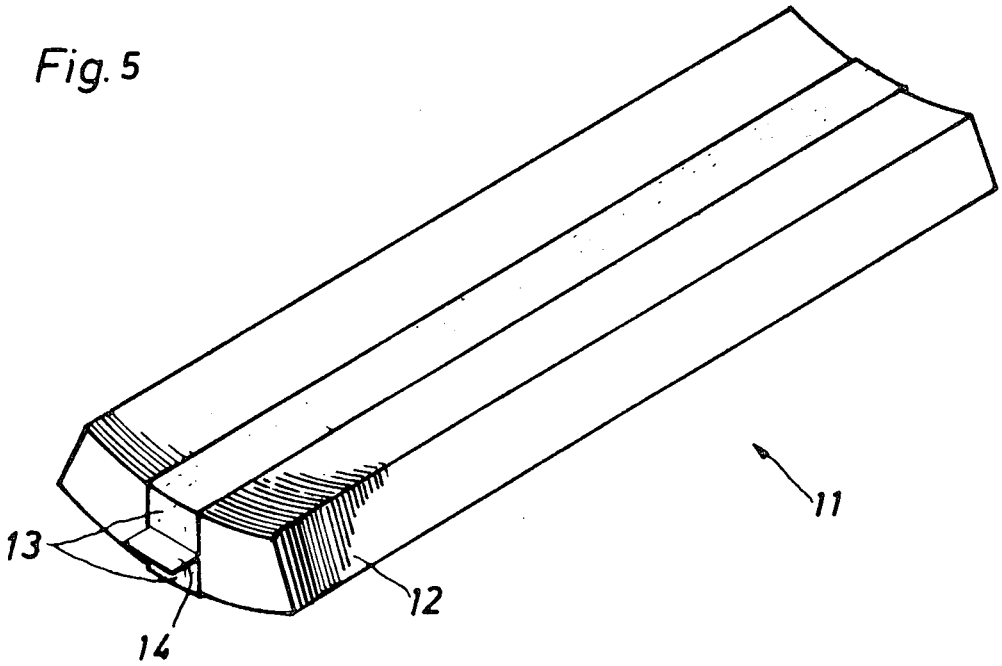

The package unit 11 according to FIG. 5 comprises approximately 6000 identical closely stacked and aligned breast labels 12 and a pair of adhesive tapes 13. The two adhesive tapes extend tightly stretched along the upper and lower longitudinal sides of the stack and adhere to the edges of the labels. They continue across the two end labels which serve as covers; they adhere to the end labels and they are connected together at their ends in the form of a handling tab 14. The adhesive tapes 13 exert a pressure in the longitudinal direction of the stack via the end labels upon the intermediate labels so as to enhance their mutual friction. As a result, and due to the sticking of the labels to the adhesive tapes, the labels are tied into a stable, barlike manipulation and transport unit. Small elastic torsional twists or bendings of the stack are entirely permissible since the fixation of the labels is thereby not affected. In the case of larger labels, two pairs of adhesive tapes may be used which are preferably arranged symmetrically with respect to the center axis of the stack and extend along the upper and lower longitudinal sides of the stack parallel to each other.

The package unit 11 may be produced, for instance, by partitioning a corresponding number of labels in the discharge chute of a label stamping press and by compressing the partitioned labels from opposite ends. Thereafter, the compressed stack is guided toward two adhesive tapes which are connected together at their free ends and are pulled under tension from two supply reels at opposite sides of the chute. Advance movement of the stack is continued until the adhesive tapes cover the leading end face and two longitudinal sides of the stack. The tapes are then joined together by pressing them against each other behind the stack, and they are then cut within the zone of the joint.

At the consumer of the labels the adhesive tapes are first severed at one end face of the stack and the leading label is swung away. The refill unit is then inserted bodily into the label container or the like of a labeling machine, whereupon the adhesive tapes may be pulled off entirely and the label stack is engaged with the automatic label feeding mechanism.

Figure 6:
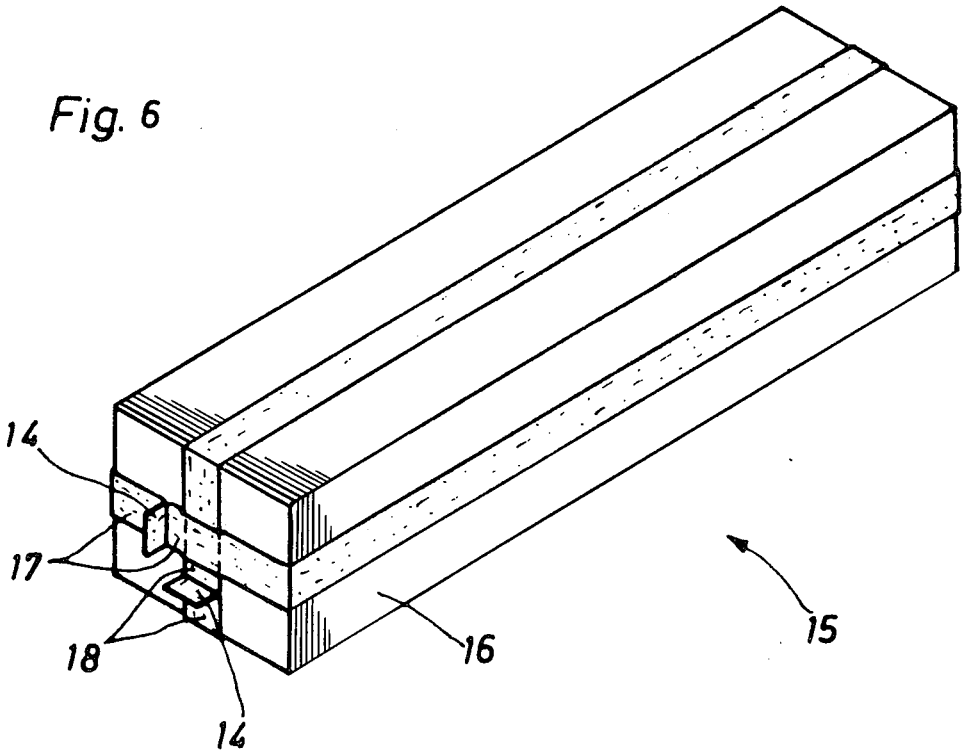

The package unit 15 according to FIG. 6 comprises about 6000 identical closely stacked and aligned rectangular main labels 16 and two pairs of adhesive tapes 17 and 18. The pair 17 extends along the two side faces while the other pair 18 runs over the lower and upper longitudinal sides of the stack. At the two end faces the adhesive tapes cross each other and again provide handling tabs 14. The two handling tabs at one end face are spaced from the center of the latter, that is, the handling tab of one pair is offset from the handling tab of the other pair of adhesive tapes. It is sufficient, however, to locate the handling tab 14 of the tapes 18, which are covered by the tapes 17, in an off center position. The handling tab 14 of the tapes 17, on the other hand, may be located on center over the tapes 18.

The production and use of the transport and refill unit 15 are similar in principle to the production and use of the transport and refill unit 11, and the two pairs of adhesive tapes may be applied at the same time or one after the other.

what is claimed is:

1. A unitary label package comprising a continuous stack of several thousand identical individual labels and at least two adhesive tapes extending lengthwise of said stack whereby said individual labels are tied into stable transport and refill unit which is directly insertable into the magazine of a labeling machine, said tapes being adhered along opposite sides of the stack and around the end faces thereof, said tapes being under tension whereby to exert contracting pressure upon the stack, said tapes having an adhesive coating facing the stack in which the cohesion of the coating to the tapes is greater than the adhesion of the coating to the stack so that substantially none of the coating remains on the stack after the tapes have been peeled off the stack.

2. A unitary label package as set forth in claim 1 and further comprising at least one elongated backing element for said labels, said backing element and labels being tied together by said binding element.

3. A unitary label package as set forth in claim 2 wherein said backing element is made of cardboard.

4. A unitary label package as set forth in claim 1 and further comprising a wrapper of filmlike packing material.

5. A unitary label package as set forth in claim 1 wherein end portions of said adhesive tapes are adhered to one another at least at one end of the stack and are extended to provide a handling tab at least at one end of the stack.

6. A unitary label package as set forth in claim 1 wherein two pairs of such adhesive tapes cross each other at the opposite end faces of said stack, and wherein end portions of said tapes are extended to provide a pair of relatively offset handling tabs at least at one end of said stack.

* * * * *